US005971103A

United States Patent [19]

Mulvaney

[11] Patent Number: 5,971,103

[45] Date of Patent: Oct. 26, 1999

[54] ACCESSORY SUPPORT APPARATUS FOR USE WITH A LADDER

[76] Inventor: Thomas Mulvaney, 9844 Winner Rd., Independence, Mo. 64052

[21] Appl. No.: 09/235,949

[22] Filed: Jan. 22, 1999

[51] Int. Cl.[6] ..... E06C 7/14

[52] U.S. Cl. ..... 182/129; 248/238

[58] Field of Search ..... 182/129, 120; 248/210, 211, 238

[56] References Cited

U.S. PATENT DOCUMENTS

| | | | |
|---|---|---|---|
| 1,339,025 | 5/1920 | Garst . | |
| 3,822,846 | 7/1974 | Jesionowski | 182/129 |
| 4,310,134 | 1/1982 | Schopp | 248/210 |
| 4,395,013 | 7/1983 | Wissinger . | |
| 4,662,594 | 5/1987 | Dubis . | |
| 5,083,733 | 1/1992 | Marino | 248/210 |
| 5,333,823 | 8/1994 | Joseph | 248/210 |
| 5,862,844 | 10/1998 | Purdy . | |

FOREIGN PATENT DOCUMENTS

| | | | |
|---|---|---|---|
| 625362 | 8/1927 | France | 248/238 |
| 2499145 | 8/1982 | France | 182/120 |

*Primary Examiner*—Alvin Chin-Shue
*Attorney, Agent, or Firm*—Shook, Hardy & Bacon LLP

[57] ABSTRACT

An accessory support apparatus is provided for use with an aluminum ladder or the like having a pair of laterally spaced rails and a plurality of open-ended D-shaped rungs extending between the rails. The support apparatus includes an elongated body having a first end that is D-shaped for receipt in the open ends of the rungs, and a support tray received on an opposed end of the body for supporting a can, bucket, brush, tool or the like for easy access by a person climbing the ladder. The support tray is preferably received on the body of the apparatus for relative pivotal movement, and can be secured in place in any of a plurality of different angular orientations so that the tray is properly positioned for use. In addition, an assembly can be provided for securing the apparatus in place on a ladder to prevent it from falling from the ladder or being inadvertently removed.

7 Claims, 3 Drawing Sheets

ACCESSORY SUPPORT APPARATUS FOR USE WITH A LADDER

CROSS-REFERENCE TO RELATED APPLICATIONS

"Not Applicable".

STATEMENT REGARDING FEDERALLY SPONSORED RESEARCH OR DEVELOPMENT

"Not Applicable".

BACKGROUND OF THE INVENTION

This invention relates generally to accessory support devices for use with ladders, and more particularly to an apparatus for use with aluminum extension ladders for supporting paint cans, brushes, tools, cleaning equipment and other accessories commonly used by individuals while climbing such ladders.

Aluminum extension ladders are commonly used by house painters, window cleaners, roofers, repairmen and the like for reaching hard-to-reach heights around homes and businesses to complete painting, cleaning, construction and/or repair projects. Such ladders commonly are constructed of one or more ladder extensions, wherein each extension includes a pair of laterally spaced side rails between which numerous, vertically spaced rungs extend. Typically, the rungs are D-shaped tubes that protrude through corresponding D-shaped holes in the rails, and are bent back against the rails or otherwise deformed such that the rungs are rigidly secured to the rails. As such, each rung is open-ended at both ends.

Because this known type of ladder is extremely versatile and relatively inexpensive, it is used by individuals in the performance of many varied tasks such as house painting, window cleaning and the like. However, some skill and care must be employed by anyone climbing on ladders, and it is often difficult for a person to hold all of the accessories required for a particular task while remaining balanced on the ladder. As such, any type of accessory support apparatus that can be used in combination with ladders will facilitate use of the ladder in completing various tasks, and will reduce any danger of injury that might otherwise occur if a person removed both hands from the ladder in order to hold such accessories.

BRIEF SUMMARY OF THE INVENTION

It is an object of the present invention to provide an accessory support apparatus that can be easily mounted on a ladder at any of a plurality of heights corresponding to the heights of the ladder rungs, and that is capable of supporting accessories to the side of the ladder where most convenient to a person climbing the ladder.

In accordance with these and other objects evident from the following description of a preferred embodiment of the invention, an accessory support apparatus is provided for use with an aluminum ladder or the like having a pair of laterally spaced rails and a plurality of open-ended shaped rungs extending between the rails. The support apparatus includes an elongated body having a first end that is D-shaped for receipt in the open ends of the rungs, and a support tray received on an opposed second end of the body for supporting a can, bucket, brush, tool or the like for easy access by a person climbing the ladder. The support tray is preferably received on the body of the apparatus for relative pivotal movement, and can be secured in place in any of a plurality of different angular orientations so that the tray is properly positioned for use. In addition, an assembly can be provided for securing the apparatus in place on a ladder to prevent it from falling from the ladder or being inadvertently removed.

By providing a support apparatus in accordance with the present invention, numerous advantages are realized. For example, by providing a support apparatus that fits in the existing end openings of the rails of a conventional ladder, a construction results which is simple and inexpensive to construct and easy to use, and which can be selectively positioned outboard of the rails of the ladder adjacent any of the rungs to support work accessories in locations convenient to a person climbing the ladder.

BRIEF DESCRIPTION OF THE SEVERAL VIEWS OF THE DRAWING

The preferred embodiment of the present invention is described in detail below with reference to the attached drawing, wherein.

DETAILED DESCRIPTION OF THE INVENTION

Figures 1, 2, 3:
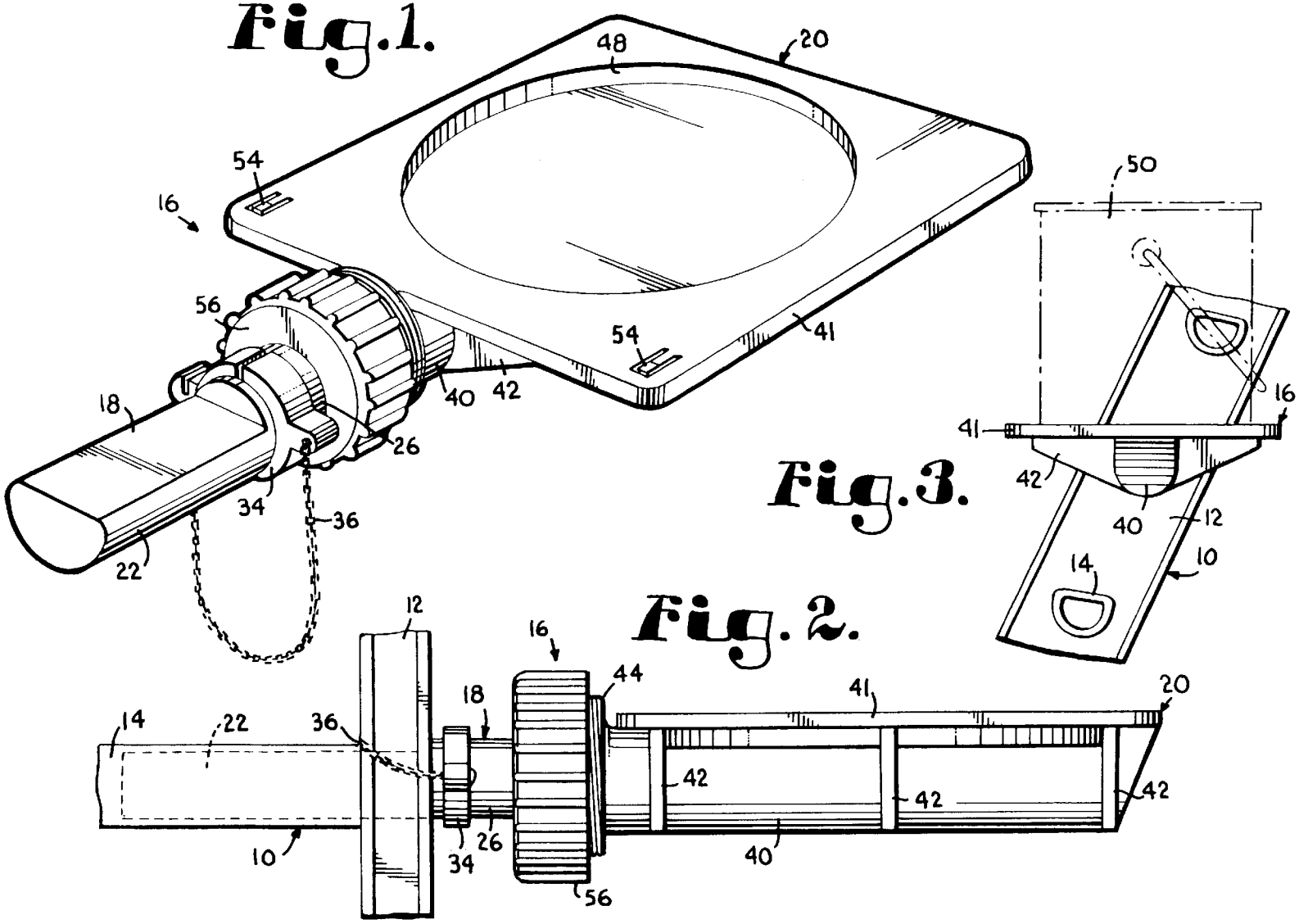
FIG. 1 is a perspective view of a support apparatus constructed in accordance with the preferred embodiment.
FIG. 2 is a front elevational view of the apparatus.
FIG. 3 is a side elevational view of a ladder on which the apparatus is mounted.

A conventional aluminum extension ladder 10 is illustrated in FIG. 3, and includes a plurality of extensions, each of which is constructed from a pair of laterally spaced side rails 12 and a plurality of rungs 14 extending horizontally between the rails. The rails 12 of each extension are typically channel shaped to add rigidity to the ladder and to receive the adjacent ladder extensions for relative sliding movement such that the ladder can be extended and retracted as desired.

The rungs 14 of the conventional ladder 10 are formed of D-shaped tubes, and protrude through corresponding D-shaped holes in the rails of each extension. Preferably, the ends of the rungs are bent back against the rails to fix the rungs to the rails. However, other fastening expedients may also be used. By providing this construction, the rungs 14 present opposed open D-shaped ends that are accessible from the sides of the ladder such that it is possible to look completely through each rung from one end to the other.

Figure 4:
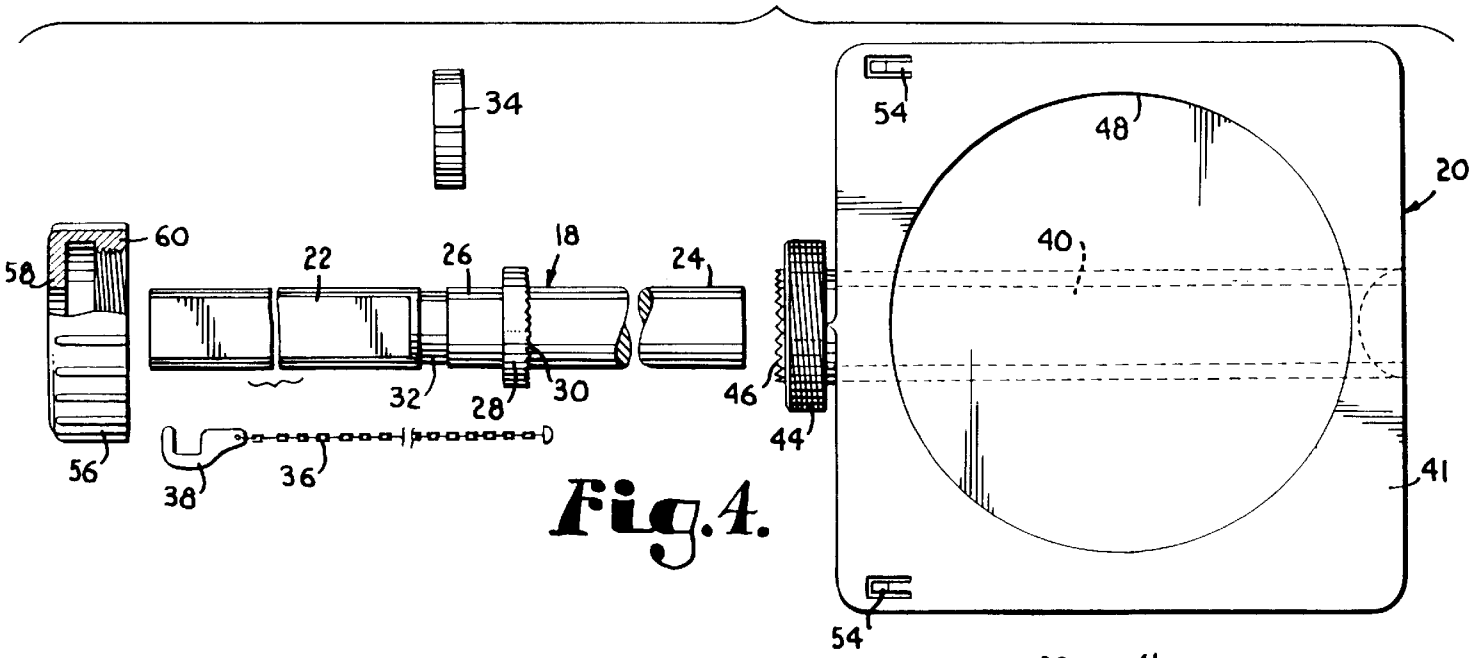
FIG. 4 is an exploded top plan view of the apparatus, partially in section.

The support apparatus 16 is shown in FIG. 1, and broadly includes a body 18 and a support tray 20. As illustrated in FIG. 4, the body 18 is elongated, presenting first and second axial ends 22, 24 which are separated from one another by an intermediate region 26. The first end 22 of the body is D-shaped in cross-section, as shown in FIG. 1, to correspond in shape and size to the open ends of the ladder rungs. As such, the body 18 can be inserted into either end of any rung to position the apparatus at the same height as the rung.

Returning to FIG. 4, the second end 24 of the body presents a smooth cylindrical outer surface that is adapted to receive the support tray 20, and defines a longitudinal axis about which the tray can be pivoted relative to the body. A circumferential flange 28 protrudes from the intermediate region 26 of the body adjacent the second end 24, and presents a plurality of axially facing teeth 30 that restrict pivotal movement of the tray when the tray is secured to the body, as described below. In addition, the flange 28 positions the tray along the length of the body.

The intermediate region 26 of the body also presents a cylindrical outer surface, and includes a circumferential groove or channel 32 adjacent the first end of the body. The groove is sized for receipt of a split ring 34 to which a strap 36 is secured such that the apparatus can be fastened to the ladder after it is positioned in one of the ends of a ladder rung. Preferably, the strap 36 is a chain having a first end secured to the split ring 34 and a second free end on which a hook 38 is provided. The split ring includes a slot or the like formed in a lobe of the ring which protrudes radially therefrom at a position diametrically opposed to the point at which the first end of the chain is secured such that after the apparatus is inserted into one of the rung ends, the chain can be trained around the adjacent rail of the ladder and fastened secured in the slot, holding the apparatus in place and preventing it from being inadvertently pushed or pulled from the ladder. The configuration of the split ring 34 allows the ring to be clipped onto or removed from the body, as desired.

Figure 5:
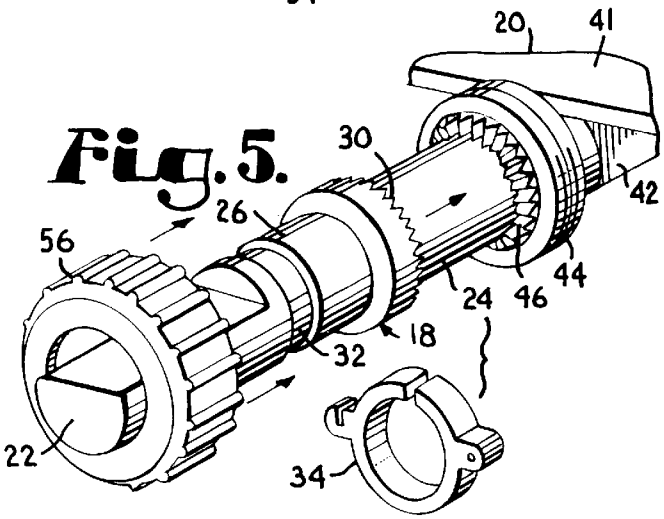
FIG. 5 is a fragmentary perspective view of the apparatus, illustrating the manner in which the apparatus is assembled.

As shown in FIG. 2, the support tray 20 includes a tubular mounting arm 40, a plate 41 secured to the outer surface of the mounting arm, and a plurality of gussets 42 connected between the tray and the arm to rigidify the assembly. The mounting arm 40 includes a smooth cylindrical inner surface sized for sliding receipt on the cylindrical outer surface of the second end 24 of the body 18, as shown in FIG. 5, and presents a free end having a threaded outer surface 44. The free end of the arm also presents a plurality of axially facing teeth 46 that cooperate with the teeth 30 on the body flange 28 to position the tray relative to the body when the body is secured in place on the body.

As illustrated in FIG. 4, the generally square plate 41 presents upper and lower surfaces and four side edges extending around the periphery thereof As shown in FIG. 3, the gussets 42 are secured to the bottom surface of the plate, and are undercut slightly so that the ends of the gussets do not reach completely to the lateral side edges of the tray. The upper surface of the tray is adapted to support accessories and, as illustrated in FIG. 1, preferably includes a circular depression 48 sized for receipt of a one gallon paint can or the like 50, shown in FIG. 3. However, it is understood that any number of holes, depressions, compartments or the like could be formed in the tray to adapt its use with particular accessories such as painting, cleaning, roofing or construction tools or supplies.

Figure 6:
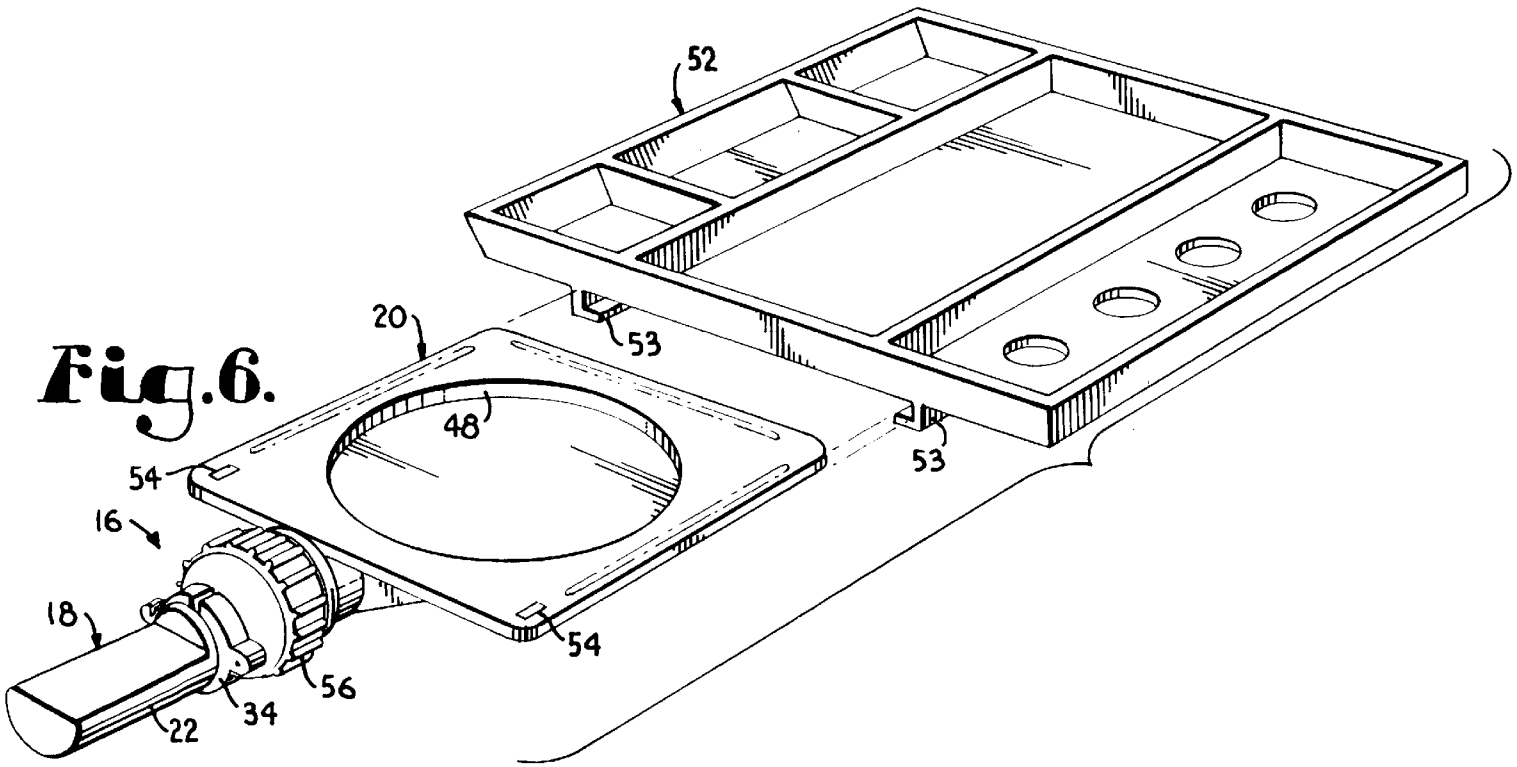
FIG. 6 is a perspective view of the apparatus and of a tool holder adapted for use with the apparatus.

If desired, it is possible to provide one or more tool holders adapted for sliding receipt on the support tray such that the tray can be customized for particular applications. For example, as shown in FIG. 6, a tool holder 52 can be provided which includes an upper surface in which a number of compartments are formed for holding various supplies, and through which several holes extend for supporting brushes and other tools. The tool holder includes a pair of laterally spaced depending L-shaped channels 53 that engage the side edges of the support tray to hold the holder on the tray during use, and that permit the holder to be slid on and off the tray, as desired.

Figure 7:
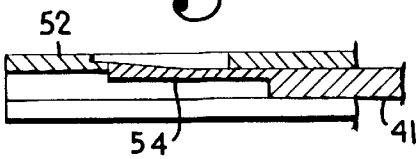
FIG. 7 is a fragmentary sectional view of a locking arrangement employed between the tool holders and the support tray.
Figure 8:
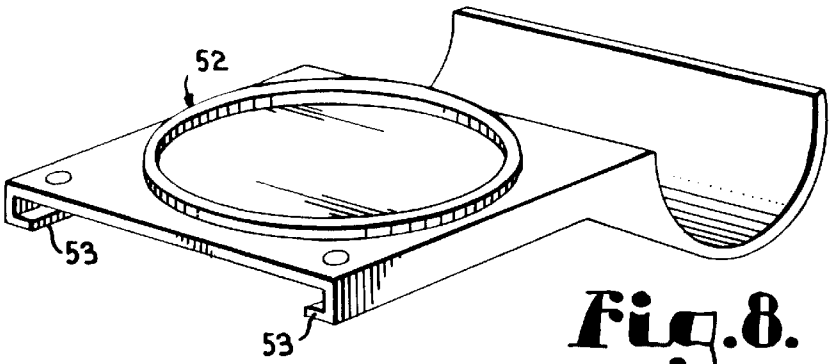
FIG. 8 is a perspective view of a second tool holder adapted for use with the apparatus.

Preferably, the tray 20 includes a pair of laterally spaced, upwardly extending spring fingers 54, shown in FIG. 1, that protrude above the upper surface of the plate 41, and the tool holder 52 includes a pair of openings aligned with the spring fingers. As such, when the tool holder is slid completely onto the tray, the spring fingers 54 extend into the openings in the holder 52 and engage the holder as illustrated in FIG. 7, such that it is locked in place on the tray. In order to remove the holder, the spring fingers are depressed, releasing the holder for sliding movement from the tray. It is understood that many different tool holder constructions could be employed with the support apparatus without departing from the scope of the invention as described herein. For example, as shown in FIG. 8, a tool holder could be constructed with hooks for suspending a paint roller or other supplies and tools, or could include any known type of support expedient so long as the holder includes structure that enables it to be fastened to the support tray and thus held in position relative to the ladder.

As mentioned, the body 18 and the tray 20 both present axially facing teeth 30, 46, as shown in FIG. 5, that cooperate to hold the tray in a desired orientation relative to the body when the tray is slid axially against the flange of the body. A collar 56 presenting a stepped inner surface is provided for holding the tray against the flange and, as shown in FIG. 4, includes a small diameter section 58 that is smaller than the flange of the body and a large diameter section 60 that is threaded for receipt on the mounting arm of the support tray to retain the support tray against angular movement. With reference to FIG. 5, in order to rotate the tray on the body, the collar 56 is unthreaded from the mounting arm 40 of the tray 20 and pulled away from the flange 28, freeing the tray so that it can be shifted axially out of engagement with the teeth of the flange and rotated freely on the second end of the body. Once the tray is in a desired orientation, it is pressed axially against the flange so that the teeth 46, 30 on the tray and flange engage one another, and the collar 56 is threaded onto the mounting arm to secure the tray in place.

In order to assemble the apparatus, the collar 56 is slid onto the second end 24 of the body 18 and the split ring is snapped into the channel to retain the collar on the intermediate region of the body. Thereafter, the tray 20 is slid onto the second end of the body and pressed against the flange so that the collar can be threaded onto the mounting arm of the tray to lock it in place. Thereafter, the apparatus is mounted on a ladder by simply inserting the first end 22 of the body into an open end of one of the rungs of the ladder 10 so that the tray extends laterally from the ladder at a convenient height relative to the work to be performed. The chain 36 is then wrapped around the rail adjacent to the apparatus and hooked to the split ring 34 to prevent the apparatus from being slid from the rung inadvertently. As such, the only way to remove the apparatus is to first unhook the chain and remove it from around the rail.

With the body 18 in place on one of the rungs 14, it is possible to orient the tray 20 at a desired angle by loosening the collar 56 from the mounting arm of the tray, and shifting the tray axially out of engagement with the teeth 30 on the flange 28. Thereafter, the tray can be rotated on the second end 24 of the body to any desired orientation before again being slid against the flange and locked in place by the collar. Thus, the orientation can be adjusted to accommodate use of the apparatus on either side of the ladder, or in different situations where the angle of the ladder relative to the ground varies.

Although the invention has been described with reference to the preferred embodiment illustrated in the attached drawing figures, it is noted that substitutions may be made and equivalents employed herein without departing from the scope of the invention as recited in the claims.

I claim:

1. An accessory support apparatus for use with a ladder having a pair of laterally spaced rails and a plurality of open-ended D-shaped rungs extending between the rails, the support apparatus comprising:

an elongated body including a first end that is D-shaped for receipt in the open ends of the rungs, an opposed second end having a cylindrical outer surface and defining a central longitudinal axis, and a flange positioned intermediate the first and second ends; and a support tray including a tubular mounting arm sized for both axial and pivotal sliding receipt on the second end of the body such that the support tray can be shifted axially of and rotated relative to the body between a plurality of angular positions, the mounting arm of the support tray and the flange of the body presenting teeth that engage one another when the support tray is moved axially along the second end of the body into contact with the flange to position the support tray relative to the body.

2. An apparatus as recited in claim 1, further comprising a strap having opposed ends that can be fastened to the apparatus around one of the rails of the ladder for preventing the apparatus from falling from the open ends of the rungs.

3. An apparatus as recited in claim 1, further comprising a securing means for securing the apparatus to the ladder to prevent the apparatus from falling from the open ends of the rungs.

4. An apparatus as recited in claim 1, further comprising a means for selectively securing the support tray to the body in any one of the plurality of angular orientations.

5. An apparatus as recited in claim 1, further comprising a tool holder sized for receipt on the support tray.

6. An apparatus as recited in claim 5, wherein the support tray includes a pair of laterally spaced side edges and the tool holder includes a pair of laterally spaced channels that are received on the side edges of the support tray to position the tool holder on the tray.

7. An accessory support apparatus for use with a ladder having a pair of laterally spaced rails and a plurality of open-ended D-shaped rungs extending between the rails, the support apparatus comprising:

an elongated body having a first end that is D-shaped for receipt in the open ends of the rungs, a cylindrical second end defining a pivot axis, and a flange positioned adjacent the second end;

a support tray received on the second end of the body for relative pivotal movement about the pivot axis between a plurality of angular orientations, the support tray including a threaded tubular mounting arm sized for receipt on the second end so that the support tray can be rotated on the second end to adjust the angular orientation of the support tray, the flange and support tray including axially extending teeth that engage one another to position the support tray in each of the plurality of orientations; and a collar presenting a stepped inner surface including a small diameter section that is smaller than the flange of the body and a large diameter section that is threaded for receipt on the mounting arm of the support tray to retain the support tray in one of the angular orientations.

* * * * *